United States Patent [19]

Hinata et al.

[11] 4,040,841

[45] Aug. 9, 1977

[54] SILVER HALIDE PHOTOGRAPHIC EMULSION

[75] Inventors: Masanao Hinata; Haruo Takei; Akira Sato; Tadashi Ikeda; Atsuo Iwamoto, all of Minami-ashigara, Japan

[73] Assignee: Fuji Photo Film Co., Ltd., Minami-ashigara, Japan

[21] Appl. No.: 602,508

[22] Filed: Aug. 6, 1975

[30] Foreign Application Priority Data

Aug. 9, 1974 Japan ..... 49-91369

[51] Int. Cl.[2] ..... G03C 1/14

[52] U.S. Cl. ..... 96/126; 96/140

[58] Field of Search ..... 96/126, 139, 140

[56] References Cited

U.S. PATENT DOCUMENTS

| | | | |
|---|---|---|---|
| 3,808,009 | 4/1974 | Sakazume et al. | 96/126 |
| 3,822,136 | 7/1974 | Sakazume et al. | 96/126 |
| 3,837,862 | 9/1974 | Shiba et al. | 96/126 |
| 3,881,936 | 5/1975 | Hayakawa et al. | 96/126 |
| 3,890,154 | 6/1975 | Ohkubo et al. | 96/126 |

*Primary Examiner*—J. Travis Brown

*Attorney, Agent, or Firm*—Sughrue, Rothwell, Mion, Zinn and Macpeak

[57] ABSTRACT

A silver halide photographic emulsion spectrally sensitized in the relatively shorter wavelength region ranging from blue to green with a supersensitizing combination of at least one sensitizing dye represented by the general formula (I)

(I)

wherein $Z^1$ represents the atoms necessary to form a benzimidazole ring, an oxazole ring, a benzoxazole ring or a naphthoxazole ring; $Z^2$ represents the atoms necessary to form a thiazole ring, a benzothiazole ring, a naphthothiazole ring, a selenazole ring, a benzoselenazole ring or a naphthoselenazole ring; $R^1$ and $R^2$ each represents an aliphatic group containing up to 8 carbon atoms, which may be unsubstituted or substituted, and the carbon chain of which may be interrupted with an oxygen atom or a sulfur atom; $R^3$ represents an alkyl group containing up to 3 carbon atoms, an aryl group or an aralkyl group; $X^1$ represents an acid anion; and *m* represents 1 or 2, wherein *m* equals 1 when the dye forms an intramolecular salt; and at least one dye selected from the group consisting of a simple merocyanine and a dimethinemerocyanine dye, or with a supersensitizing combination of at least one sensitizing dye represented by the general formula (I) as defined above and at least one sensitizing dye represented by the general formula (II)

(II)

wherein $Z^3$ represents the atoms necessary to form a 5- or 6-membered heterocyclic ring; Q represents the atoms necessary to form a rhodanine ring, a thiohydantoin ring or a 2-thioxazolidinedione ring; $R^4$ represents an aliphatic group containing up to 4 carbon atoms, which may be unsubstituted or substituted and the carbon chain of which may be interrupted by an oxygen atom or a sulfur atom; $R^5$ represents a hydrogen atom, an alkyl group, an aryl group or an aralkyl group; and *n* represents 1 or 2.

11 Claims, 4 Drawing Figures

SILVER HALIDE PHOTOGRAPHIC EMULSION

BACKGROUND OF THE INVENTION

1. Field of the Invention

The present invention relates to silver halide photographic emulsions which are spectrally sensitized and particularly those which are supersensitized with a combination of at least two kinds of sensitizing dyes.

2. Description of the Prior Art

A wide variety of sensitizing dyes are known to be useful for the purpose of spectral sensitization of silver halide photographic emulsions. In a specific wavelength region ranging over relatively shorter wavelengths, e.g., from the blue to green wavelength region, various kinds of sensitizing dyes are available. Especially, merocyanine dyes are often employed for this purpose. However, spectral sensitization with merocyanine dyes can occasionally result in unsatisfactory characteristics in the silver halide photographic emulsions with respect to a wide variety of purposes thereof.

For photographic materials for plate making, and particularly the so-called litho-films wherein the formation of half-tone dots is achieved by the combined use of an original having a continuous tone and a contact screen, merocyanine dyes are known to be effectively used with the intention of sensitizing these materials in the blue and green wavelength regions. As disclosed in, for example, German Patent Application (OLS) No. 2,239,711, merocyanine dyes have been employed for the sensitization of silver halide emulsions for producing lithographic light-sensitive materials since merocyanine dyes reduce the gradation thereof only slightly, and particularly, simple merocyanine dyes can sensitize these materials in the blue wavelength region, while dimethinemerocyanine dyes can sensitize these materials in both the blue and green wavelength regions. However, merocyanine dyes alone are insufficient to obtain silver halide emulsions for "lithographic" type light-sensitive materials having an additional high sensitivity in the green wavelength region, while keeping the high contrast thereof. An X-ray recording material contains sometimes an intensifying screen or fluorescent screen together with silver halide photographic film in order to enhance the sensitivity to X-ray recording. In order to minimize the amount of exposure to X-rays which are harmful to the human body, many devices for increasing the sensitivity to X-ray recording have been proposed. For example, a system using an X-ray image intensifier, a system using a solid state light amplifier and so on have been developed. In all cases, fluorescent images are recorded on silver halide photosensitive materials in the final process. Phorphors which can be employed for this purpose include blue phosphors such as calcium tungstate, zinc sulfate activated with silver, barium sulfate activated with silver, etc., and green phosphors such as cadmium zinc sulfide activated with silver, etc. In conventional X-ray recording sensitive materials, substantially all of these materials can be roughly divided into two types; one type is a regular type in which the sensitive region inherent in a silver halide emulsion is utilized, and the other type includes those materials which are spectrally sensitized orthochromaticly. The characteristics of these materials can be attributed to both the convenience in treating X-ray recording sensitive materials under as bright a safelight as is possible, and the illumination energy maximum of conventional phosphors lying in a relatively short wavelength region (about 540 - 550 nm on the longer side). However, materials which are highly sensitized to fluorescent light even if safelight safety is sacrificed to increase the sensitivity have recently been required in order to reduce even more the amount of exposure to X-rays. Spectral sensitization with merocyanine dyes alone does not satisfy very well the above-described requirements.

Spectral sensitization with known merocyanine dyes is still sufficient to satisfy the other requirements based on the characteristics of photographic materials other than the above-described characteristics, for example, reciprocity law failure caused by high intensity illumination, sensitization reduction with the lapse of time, color remaining after processing, reduction in green-sensitivity in the presence of couplers in case of color photographic emulsions, and so on.

SUMMARY OF THE INVENTION

Therefore, an object of the present invention is to provide a silver halide photographic emulsion which is rendered highly green-sensitive by spectral sensitization.

Another object of the present invention is to provide a silver halide photographic emulsion wherein the reciprocity law failure caused by high intensity illumination can be reduced.

A further object of the present invention is to provide a silver halide photographic emulsion wherein the reduction in sensitivity generally caused by the presence of sensitizing dyes and couplers can be reduced.

The above-described objects are attained with a silver halide photographic emulsion containing, in supersensitizing amounts, the combination of at least one sensitizing dye represented by the following general formula (I)

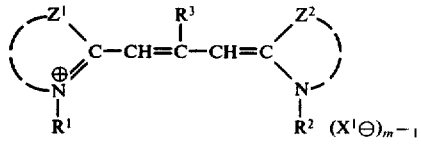

(I)

wherein $Z^1$ represents the atoms necessary to form a benzimidazole ring, an oxazole ring, a benzoxazole ring or a naphthoxazole ring; $Z^2$ represents the atoms necessary to form a thiazole ring, a benzothiazole ring, a naphthothiazole ring, a selenazole ring, a benzoselenazole ring or a naphthoselenazole ring; $R^1$ and $R^2$ each represents an aliphatic group containing up to 8 carbon atoms, which may be unsubstituted or substituted, and the carbon chain of which may be interrupted with an oxygen atom or a sulfur atom; $R^3$ represents an alky group containing up to 3 carbon atoms, an aryl group or an aralkyl group; $X^1$ represents an acid anion; and $m$ represents 1 or 2, wherein $m$ equals 1 when the dye forms an intramolecular salt; and at least one of a simple merocyanine dye or a dimethinemerocyanine dye.

In a preferred embodiment of this invention, the invention provides a silver halide photographic emulsion containing, in supersensitizing amounts, the combination of at least one sensitizing dye represented by the general formula (I) and at least one of a simple merocyanine dye or a dimethinemerocyanine dye represented by the following general formula (II)

(II)

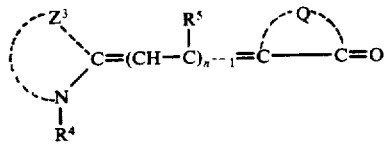

wherein $Z^3$ represents the atoms necessary to form a 5- or 6-membered heterocyclic ring; Q represents the atoms necessary to form a rhodanine ring, a thiohydantoin ring or a 2-thioxazolidinedione ring; $R^4$ represents an aliphatic group containing up to 4 carbon atoms, which may be unsubstituted or substituted and the carbon chain of which may be interrupted by an oxygen atom or a sulfur atom; $R^5$ represents a hydrogen atom, an alkyl group, an aryl group or an aralkyl group; and *n* represents 1 or 2.

DETAILED DESCRIPTION OF THE INVENTION

Figure 1:
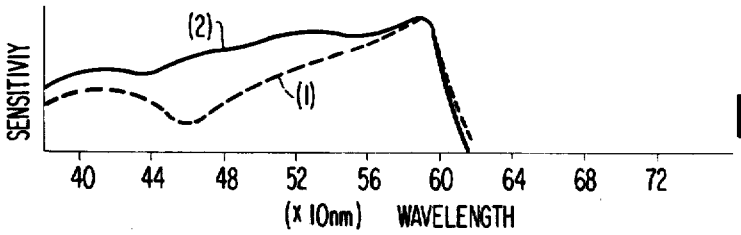
FIGS. 1 to 3 are spectrograms of sensitizing dyes of the present invention and sensitizing dyes employed for comparison. The numbers of the curves in each figures correspond to the numbers written in the column headed Spectrogram in the Table in the Examples.

Examples of heterocyclic rings formed by $Z^1$ in the general formula (I) representing the sensitizing dyes employed in the practice of the present invention include, e.g., benzimidazole rings (such as 1-methyl-5-chlorobenzimidazole, 1-methyl-5-fluorobenzimidazole, 1-methyl-5,6-dichlorobenzimidazole, 1-methyl-5,6-difluorobenzimidazole, 1-ethyl-5-chlorobenzimidazole, 1-ethyl-5-fluorobenzimidazole, 1-ethyl-5,6-dichlorobenzimidazole, 1-ethyl-5,6-difluorobenzimidazole, 1-propyl-5-chlorobenzimidazole, 1-propyl-5-fluorobenzimidazole, 1-propyl-5,6-dichlorobenzimidazole, 1-propyl-5,6-difluorobenzimidazole, 1-allyl-5-chlorobenzimidazole, 1-allyl-5-fluorobenzimidazole, 1-allyl-5,6-dichlorobenzimidazole, 1-allyl-5,6-difluorobenzimidazole, 1-ethyl-5-methoxycarbonylbenzimidazole, 1-ethyl-5-methylsulfonylbenzimidazole, 1-phenyl-5-chlorobenzimidazole, 1-phenyl-5-fluorobenzimidazole, 1-phenyl-5,6-dichlorobenzimidazole, 1-phenyl-5,6-difluorobenzimidazole, 1-ethyl-5-trifluoromethylbenzimidazole, etc.); oxazole series rings (such as oxazole, 4-methyloxazole, 5-methyloxazole, 4,5-dimethyloxazole, 4-p-tolyloxazole, benzoxazole, 5-fluoroenzoxazole, 5-chlorobenzoxazole, 5-bromobenzoxazole, 5-trifluoromethylbenzoxazole, 5-methylbenzoxazole, 5,6-dimethylbenzoxazole, 5,6-dimethoxybenzoxazole, 5-ethoxybenzoxazole, 5-phenylbenzoxazole, 5-carboxybenzoxazole, 5-methoxycarbonylbenzoxazole, 5-acetylbenzoxazole, naphtho[1,2-d]oxazole, etc.); and the like.

Examples of heterocyclic rings represented by $Z^2$ represents, e.g., thiazole series rings (such as thiazole, 4-methylthiazole, 4-phenylthiazole, 4,5-dimethylthiazole, benzothiazole, 5-chlorobenzothiazole, 5-bromobenzothiazole, 5-methylbenzothiazole, 5-methoxybenzothiazole, 5-ethoxybenzothiazole, 6-methylbenzothiazole, 6-chlorobenzothiazole, 5-carboxybenzothiazole, 5-acetylbenzothiazole, 5-methoxycarbonylbenzothiazole, 5-hydroxybenzothiazole, 5-trifluoromethylbenzothiazole, 5-cyanobenzothiazole, 5,6-dimethylbenzothiazole, 5-acetylaminobenzothiazole, 6-methoxybenzothiazole, 5,6-dimethylbenzothiazole, 5,6-dimethoxybenzothiazole, 5,6-dichlorobenzothiazole, naphtho[1,2-d]thiazole, etc.); and selenazole rings (such as selenazole, 4-methylselenazole, 4-phenylselenazole, 4,5-dimethylselenazole, benzoselenazole, 5-chlorobenzoselenazole, 5-bromobenzoselenazole, 5-methylbenzoselenazole, 5-methoxybenzoselenazole, 5,6-dimethylbenzoselenazole, naphtho[1,2-d]selenazole, etc.).

Preferred heterocyclic rings formed by $Z^3$ include oxazole, benzoxazole, naphthoxazole, thiazoline, thiazole, benzothiazole, naphthothiazole, selenazole, benzoselenazole, naphthoselenazole, pyridine, quinoline, tetrazole, pyrroline, and indolenine rings.

Specific examples of heterocyclic rings represented by $Z^3$ include, e.g., thiazoline, 2-pyridine, 4-pyridine, 2-quinoline, 4-quinoline, pyrroline, tetrazole, indolenine, 3,3-dimethylindolenine rings, and the like. $Z_3$ also represents similar oxazole series, thiazole series and selenazole series nuclei as described above for $Z^1$ and $Z^2$.

$R^1$, $R^2$ and $R^4$ each can represent an alkyl group such as an unsubstituted alkyl group (e.g., methyl, ethyl, propyl, butyl, etc.) and a substituted alkyl group having up to 4 carbon atoms in the alkyl moiety such as an alkoxyalkyl group (e.g., 2-methoxyethyl, etc.), an alkylthioalkyl group (e.g., 2-ethylthioethyl, etc.), a hydroxyalkyl group (e.g., 2-hydroxyethyl, 3-hydroxypropyl, 4-hydroxybutyl, etc.), a carboxyalkyl group (e.g., 2-carboxyethyl, 3-carboxypropyl, 4-carboxybutyl, 3-carboxybutyl, 2-(2-carboxyethoxy)ethyl, etc.), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl, etc.), a vinylethyl group, and the like.

$R^3$ represents a hydrogen atom or an alkyl group having 1 to 3 carbon atoms such as an unsubstituted alkyl group (e.g., a methyl group, an ethyl group, a propyl group or an isopropyl group) or a substituted alkyl group such as a carboxyalkyl group (e.g., 2-carboxyethyl, 3-carboxypropyl, etc.); a hydroxyalkyl group (e.g., 2-hydroxyethyl, 3-hydroxypropyl, etc.); an aryl group (e.g., phenyl, carboxy-substituted phenyl, etc.); or an aralkyl group (e.g., benzyl, phenethyl, etc.).

$R^5$ represents a hydrogen atom, an alkyl group having up to 5 carbon atoms (e.g., an unsubstituted alkyl group such as methyl, ethyl, propyl, butyl, etc., or a substituted alkyl group such as a carboxy- or hydroxy-substituted alkyl group, etc., e.g., carboxymethyl, hydroxymethyl, etc.); an aryl group (e.g., phenyl, etc.); or an aralkyl group (e.g., benzyl, phenethyl, etc.).

Examples of suitable substituents for the rings hereinbefore described for Q include an alkyl group, a carboxyalkyl group, a hydroxyalkyl group, a sulfoalkyl group and an alkoxyalkyl group, e.g., as defined for $R^4$; an alkoxycarbonylalkyl group (e.g., methoxycarbonylmethyl, methoxycarbonylethyl, ethoxycarbonylethyl, etc.); an alkenyl group (e.g., allyl, etc.); a substituted alkoxyalkyl group (e.g., hydroxymethoxymethyl, 2-hydroxyethoxymethyl, 2-(2-hydroxyethoxy)ethyl, 2-(2-acetoxyethoxy)ethyl,acetoxymethoxymethyl, etc.); a dialkylaminoalkyl group (e.g., 2-dimethylaminoethyl, 2-diethylaminoethyl, 3-dimethylaminopropyl, 2-piperidinoethyl, 2-morpholinoethyl, etc.); an N-(N,N-dialkylaminoalkyl)carbamoylalkyl group (e.g., N-[3-(N,N-dimethylamino)propyl]carbamoylmethyl, N-[2-

(N,N-diethylamino)ethyl]carbamoylmethyl, N-[3-(morpholino)propyl]carbamoylmethyl, N[3-(piperidino)-propyl]carbamoylmethyl, etc.); an N-(N,N,N-trialkylammonioalkyl)carbamoylalkyl group (e.g., N-[3-(N,N,N-trimethylammonio)propyl]carbamoylmethyl, N-[3-(N,N,N-triethylammonio)propyl]carbamoylmethyl, N-[3-(N-methylmorpholino)propyl]carbamoylmethyl, N-[3-(N-methylpiperidino)propyl]carbamoylmethyl, etc.); an N,N,N-trialkylammonioalkyl group (e.g., N,N-diethyl-N-methylammonioethyl, N,N,N-triethylammonioethyl, etc.); a cyanoalkyl group (e.g., 2-cyanoethyl, 3-cyanopropyl, etc.); a carbamoylalkyl group (e.g., 2-carbamoylethyl, 3-carbamoylpropyl, etc.); a heterocyclic ring-substituted alkyl group (e.g., tetrahydrofurfurylmethyl, furfurylmethyl, etc.); an aryl group (e.g., phenyl, p-chlorophenyl, p-tolyl, p-methoxyphenyl, p-carboxyphenyl, p-methoxycarbonylphenyl, m-acetylaminophenyl, p-acetylaminophenyl, m-dialkylaminophenyl (e.g., m-diethylaminophenyl, etc.), or p-dialkylaminophenyl (e.g., p-diethylaminophenyl, etc.)).

$X^1$ represents an acid anion, e.g., conventionally employed in cyanine dyes, such as an iodine ion, a bromine ion, a chlorine ion, a p-toluenesulfonate ion, a benzenesulfonate ion, a sulfate ion, a perchlorate ion, thiocyanate ion, etc.

The sensitizing dyes which can be used to advantage in the practice of the present invention and which are included in the above-described general formula (I) or (II), have the respective following general formula (I-1) or (II-1):

(I-1)

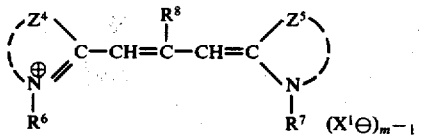

wherein $Z^4$ represents the atoms necessary to form a benzimidazole ring, a benzoxazole ring, or a naphtho[1,2-d]oxazole ring, e.g., as hereinbefore described for $Z^1$; $Z^5$ represents the atoms necessary to form a benzothiazole ring, a naphtho[1,2-d]thiazole ring, a benzoselenazole ring or a naphtho[1,2-d]selenazole ring, e.g., as hereinbefore described for $Z^2$; $R^8$ represents a hydrogen atom or an alkyl group, e.g., as hereinbefore described for $R^3$; and $R^6$, $R^7$, $X^1$ and $m$ each has the same meaning as $R^1$, $R^2$, $X^1$ and $m$ in the above-described general formula (I).

(II-1)

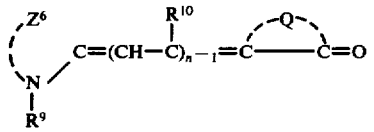

wherein $Z^6$ represents the atoms necessary to complete an oxazole ring, a benzoxazole ring, a thiazoline ring, a thiazole ring, a benzothiazole ring, a naphtho[1,2-d]oxazole ring, a pyridine ring, a quinoline ring, a pyrroline ring or a tetrazole ring, e.g., as hereinbefore described for $Z^3$; and Q, $R^9$, $R^{10}$ and $n$ each has the same meaning as Q, $R^4$, $R^5$ and $n$, respectively, in the above-described general formula (II).

Particularly useful sensitizing dyes which can be used in the practice of the present invention represented by the above-described general formula (I-1) or (II-1) have the following general formulae;

(I-2)

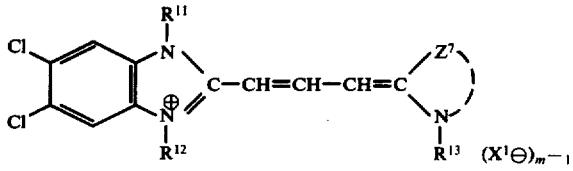

wherein $Z^7$ represents the atoms necessary to complete a benzothiazole ring, a naphtho]1,2-d]thiazole ring, a benzoselenazole ring or a naphtho[1,2-d]selenazole ring, e.g., as hereinbefore described for $Z^2$; $R^{11}$ represents a methyl group or an ethyl group; $R^{12}$ and $R^{13}$ each represents an alkyl group, a hydroxyalkyl group, a carboxyalkyl group or a sulfoalkyl group as hereinbefore described for $R^1$ and $R^2$ in the general formula (I); and $X^1$ and $m$ each has the same meaning as $X^1$ and $m$, respectively, in the general formula (I);

(I-3)

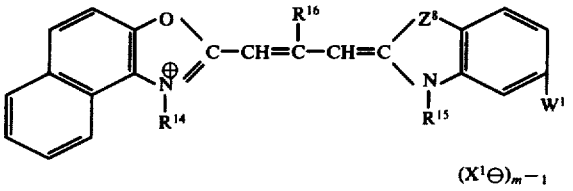

wherein $Z^8$ represents a sulfur atom or a selenium atom; $R^{16}$ represents a methyl group, an ethyl group or a propyl group; $W^1$ represents a hydrogen atom, a methyl group, an ethyl group, a methoxy group, a chlorine atom, a bromine atom, a hydroxy group or a phenyl group; and $R^{14}$, $R^{15}$, $X^1$ and $m$ each has the same meaning as $R^{12}$, $R^{13}$, $X^1$ and $m$, respectively, described above;

(I-4)

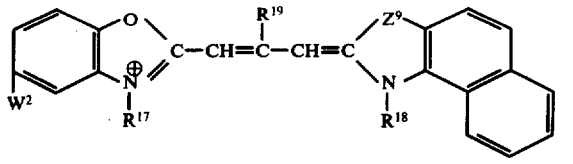

wherein $Z^9$ represents a sulfur atom or a selenium atom; and $W^2$, $R^{17}$, $R^{18}$, $R^{19}$, $X^1$ and $m$ each has the same meaning as $W^1$, $R^{14}$, $R^{15}$, $R^{16}$, $X^1$ and $m$, respectively, described above;

(I-5)

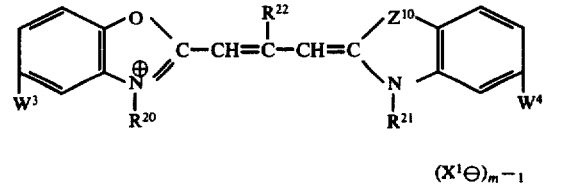

wherein $Z^{10}$ has the same meaning as the above-described $Z^9$; $R^{20}$, $R^{21}$, $R^{22}$, $X^1$ and *m* each has the same meaning as $R^{17}$, $R^{18}$, $R^{19}$, $X^1$ and *m*, respectively, described above; and $W^3$ and $W^4$ each represents a hydrogen atom, a methyl group, an ethyl group, a methoxy group, an ethoxy group, a methoxycarbonyl group, an acetyl group, a chlorine atom, a bromine atom, a phenyl group or a hydroxyl group;

(II-2)

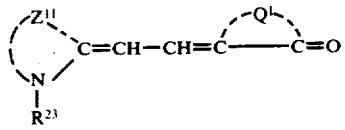

wherein $Z^{11}$ represents a benzoxazole ring or a naphtho[1,2-d]oxazole ring, e.g., as described hereinbefore for $Z^3$; $R^{23}$ represents an alkyl group, a hydroxyalkyl group, a carboxyalkyl group or a sulfoalkyl group as described for $R^4$ in the general formula (II); and $Q^1$ represents the atoms necessary to complete a thiohydantoin ring as described hereinbefore for Q;

(II-3)

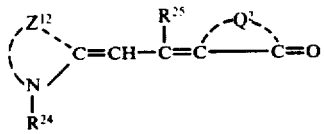

wherein $Z^{12}$ represents the atoms necessary to complete a thiazoline ring, e.g., as described hereinbefore for $Z^3$; $Q^2$ represents the atoms necessary to complete a rhodanine ring or a thiohydantoin ring, e.g., as described hereinbefore for Q; $R^{24}$ has the same meaning as $R^{23}$ described above; and $R^{25}$ represents a hydrogen atom, an alkyl group, an aryl group or an aralkyl group;

(II-4)

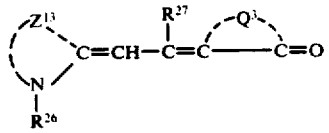

wherein $Z^{13}$ represents the atoms necessary to complete a pyrroline ring, a quinoline ring or a tetrazole ring, e.g., as described hereinbefore for $Z^3$; $Q^3$ represents the atoms necessary to complete a thiohydantoin ring, e.g., as described hereinbefore for Q; and $R^{26}$ and $R^{27}$ each has the same meaning as $R^{24}$ and $R^{25}$, respectively, described above;

(II-5)

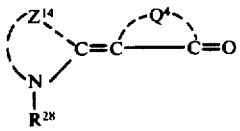

wherein $Z^{14}$ represents the atoms necessary to complete a benzoxazole ring, a benzothiazole ring, a naphtho[1,2-d]oxazole ring, a naphtho[1,2-d]thiazole ring, a benzoselenazole ring, a naphtho[1,2-d]selenazole ring, a thiazole ring or a pyridine ring, e.g., as described hereinbefore for $Z^3$; $Q^4$ represents the atoms necessary to complete a rhodanine ring, e.g., as described hereinbefore for Q; and $R^{28}$ has the same meaning as $R^{26}$ described above.

Specific examples of sensitizing dyes which can be employed in the practice of the present invention are illustrated below. However, the present invention is not to be interpreted as being limited to the dyes specifically described below.

Specific examples of the dyes represented by the general formula (I) include the following dyes.

Dye (I-A)

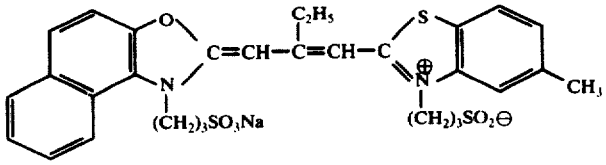

Dye (I-B)

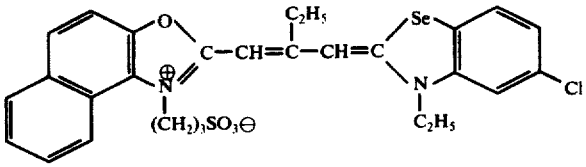

Dye (I-C)

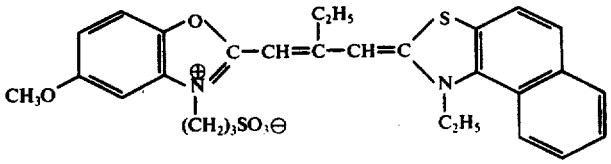

Dye (I-D)

-continued
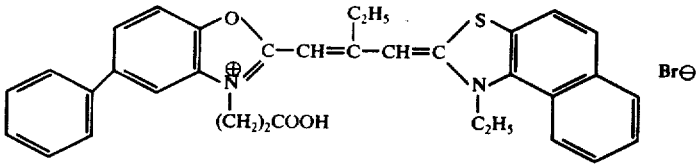
Dye (I-E)
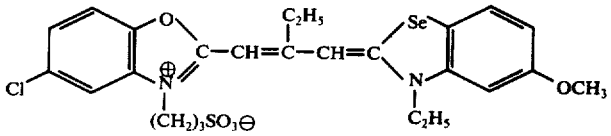
Dye (I-F)
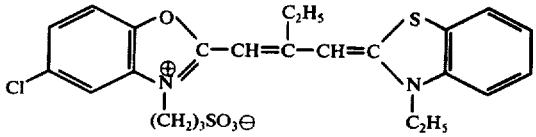
Dye (I-G)
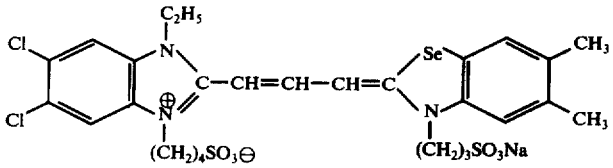
Dye (I-H)
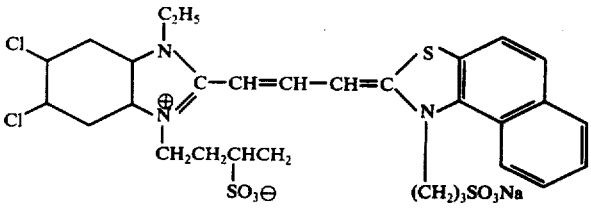
Dye (I-I)
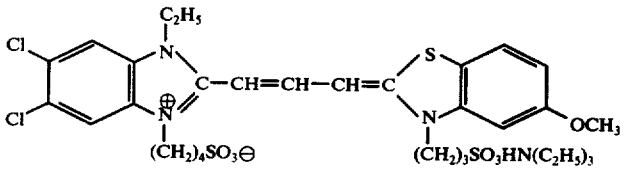
Dye (I-J)
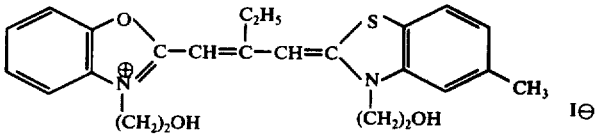
Dye (I-K)
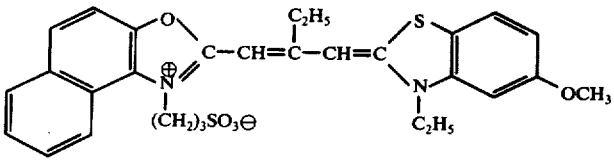
Dye (I-L)
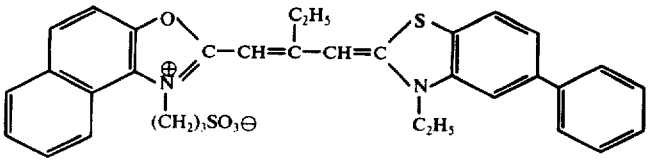

-continued
Dye (I-M)
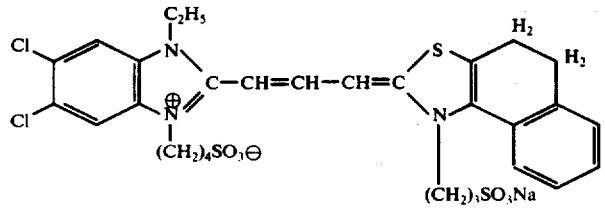
Dye (I-N)
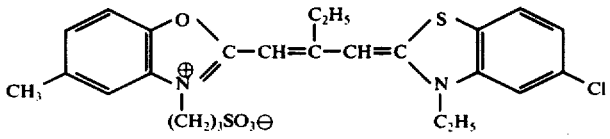
Dye (I-O)
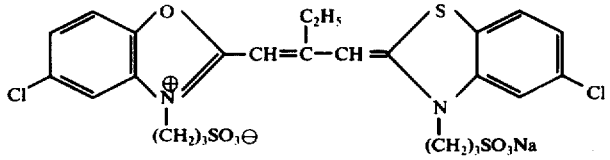
Specific examples of the dyes represented by the general formula (II) include the following dyes.
Dye (II-A)
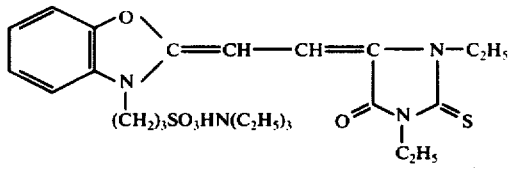
Dye (II-B)
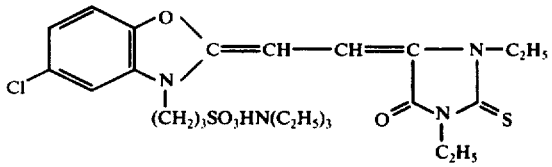
Dye (II-C)
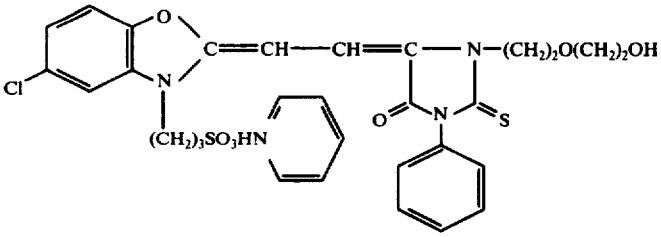
Dye (II-D)
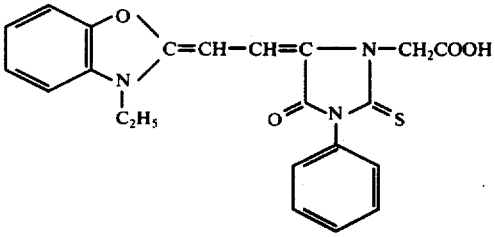
Dye (II-E)

-continued
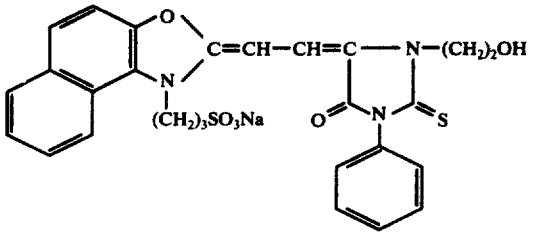
Dye (II-F)
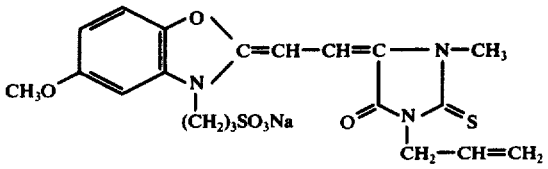
Dye (II-G)
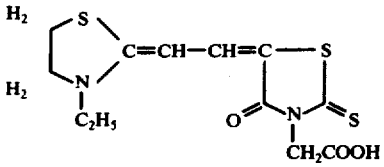
Dye (II-H)
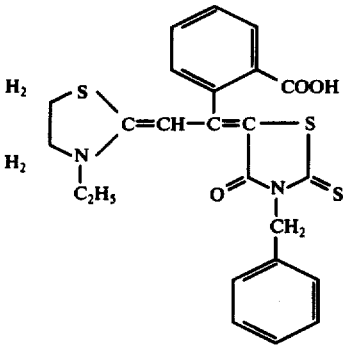
Dye (II-I)
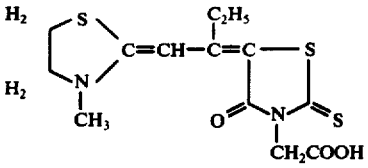
Dye (II-J)
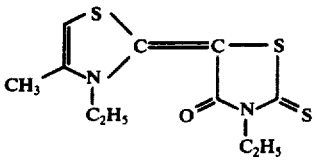
Dye (II-K)
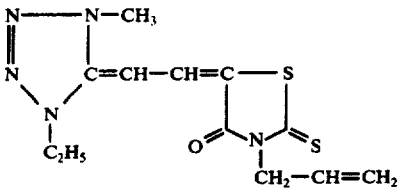
Dye (II-L)

-continued
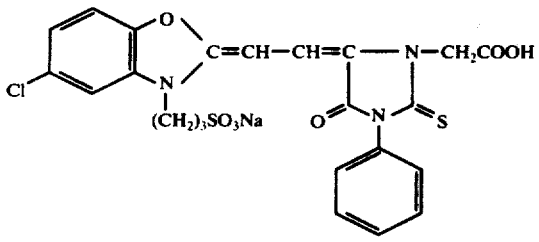
Dye (II-M)
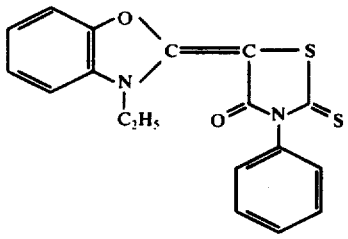
Dye (II-N)
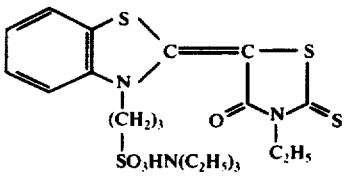
Dye (II-O)
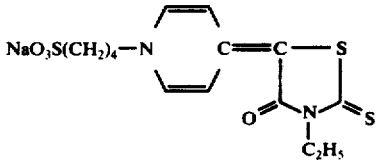
Dye (II-P)
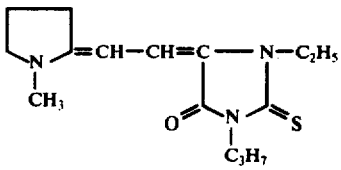
Dye (II-Q)
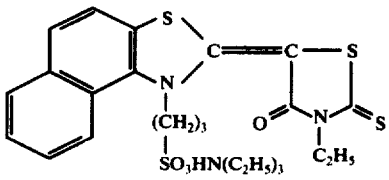
Dye (II-R)
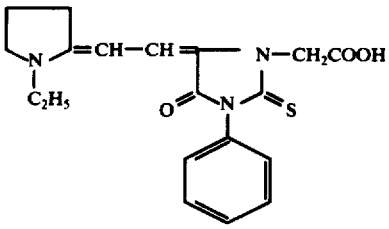
Dye (II-S)

-continued

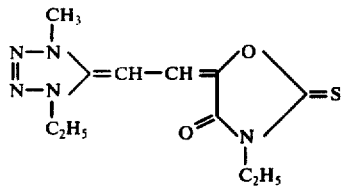

Each of those dyes is used in the amount usually employed for supersensitization, e.g., about $1 \times 10^{-6}$ mol to $5 \times 10^{-2}$ mol per mol of silver. The compounds represented by the general formula (I) or (II), each is incorporated into a silver halide emulsion in an amount preferably ranging from about $1 \times 10^{-6}$ mole to $5 \times 10^{-3}$ mol, particularly from $1 \times 10^{-5}$ mol to $2.5 \times 10^{-3}$ mol, and more particularly from $8 \times 10^{-5}$ mol to $1 \times 10^{-3}$ mol, per mol of silver. When the compound is present in an amount in excess of about $5 \times 10^{-3}$ mol, some dyes give rise the presence of residual color, a further increased amount above this reduces the gradation, and finally a reduction in sensitivity is produced. Moreover, the sensitizing efficiency decreases gradually as the amount of dyes employed decreases below about $1 \times 10^{-6}$ mol, and finally spectral sensitization is essentially not achieved when used in too small an amount.

A preferred molar ratio of the amount of the dye represented by the general formula (I) to that of the dye represented by the general formula (II) ranges from about 1:10 to 10:1.

The sensitizing dyes having the general formulae (I) and (II) which are employed for the supersensitization in the present invention, for example, are preferably added to a silver halide emulsion as solutions prepared by dissolving the dyes individually in the respective appropriate solvents. On the other hand, the dyes can be added to a silver halide emulsion as a solution prepared by dissolving both dyes together in an appropriate solvent, or they can be used as follows. Each of the sensitizing dyes is added to a separate silver halide emulsion as a solution prepared individually by dissolving the dyes each into an appropriate solvent, and then they are mixed before using.

The sensitizing dyes used in the practice of the present invention can be added as a solution prepared by dissolving the dyes in water or a water-miscible organic solvent such as methanol, ethanol, methyl Cellosolve, pyridine or the like. The sensitizing dyes can be dissolved using ultrasonic vibration, e.g., as disclosed in U.S. Pat. No. 3,485,634. In addition, suitable methods for dissolving or dispersing the sensitizing dyes used in the present invention into an emulsion include those methods as described in U.S. Pat. Nos. 3,482,981, 3,585,195, 3,469,987, 3,425,835, and 3,342,605; British Patent Nos. 1,271,329, 1,038,029 and 1,121,174; and U.S. Pat. Nos. 3,660,101 and 3,658,546. Further, the method as described in German Patent Application (OLS) No. 2,104,283 and the method as described in U.S. Pat. No. 3,649,286 can be employed.

The effect of the combination of the sensitizing dyes employed in the present invention is not deleteriously affected when known green-sensitive cyanine dyes (e.g., oxacarbocyanine dyes, imidacarbocyanine dyes, 2,2'-cyanine dyes and the like) or red-sensitive cyanine dyes are additionally used together with the combination of the dyes. Suitable cyanine dyes which can be used together with the combination of sensitizing dyes employed in the present invention have the following general formula (III) or (IV)

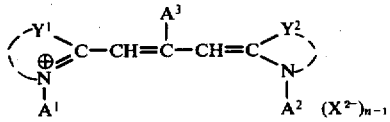

III wherein $Y^1$ and $Y^2$ each represents the atoms necessary to form a benzoxazole ring, a naphtho[1,2-d]oxazole ring, or a benzimidazole ring (which may be substituted with groups which do not adversely affect the sensitivity and so on, for example, substituents which are described above for $Z^1$ and $Z^2$ in the above-described general formula (I)); $A^1$ and $A^2$ each represents an aliphatic group (e.g., those which are described for $R^1$ and $R^2$ of the above-described general formula (I)); $A^3$ represents a hydrogen atom or an alkyl group having 1 to 3 carbon atoms; and $X^2$ and $n$ each has the same meaning as $X^1$ and $m$, respectively, of the general formula (I)

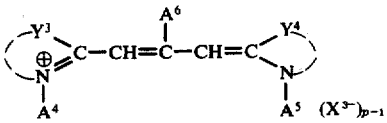

(IV)

wherein $Y^3$ and $Y^4$ each represents the atoms necessary to form a benzothiazole ring, a benzoselenazole ring, a naphtho[1,2-d]thiazole ring or a naphtho[1,2-d]selenazole ring (which may be substituted with substituents which do not adversely effect the sensitivity and so on, for example, substituents which are described above for $Z^1$ and $Z^2$ of the general formula (I)); $A^4$ and $A^5$ each represents an aliphatic group, e.g., as described hereinbefore for $A^1$ and $A^2$; $A^6$ represents an alkyl group having 1 to 3 carbon atoms or an aryl group (e.g., a phenyl group); and $X^3$ and $p$ each has the same meaning as $X^1$ and $m$, respectively, of the general formula (I).

Specific examples of cyanine dyes which can be used together with the combination of the sensitizing dyes of the present invention include the following compounds.

Dye (III-A)
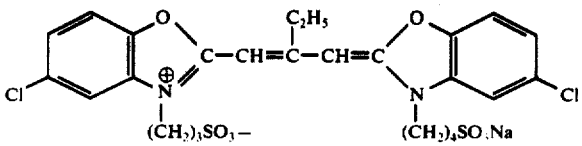
Dye (III-B)
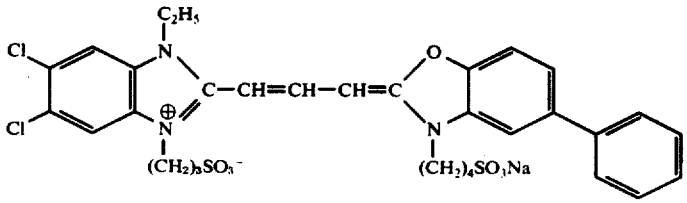
Dye (III-C)
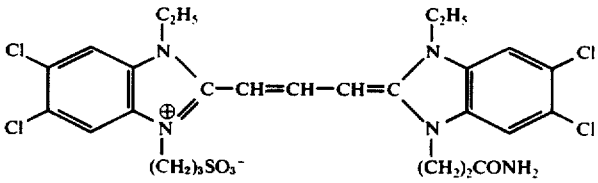
Dye (III-D)
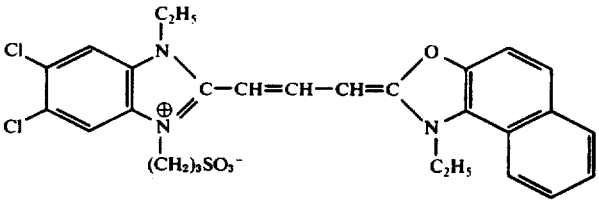
Dye (IV-A)
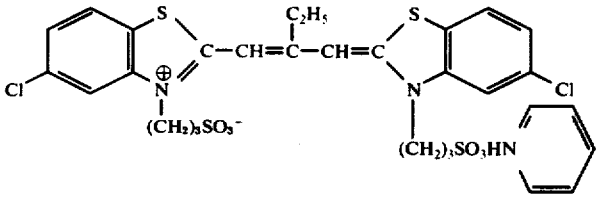
Dye (IV-B)
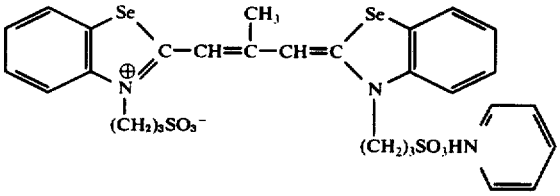
Dye (IV-C)
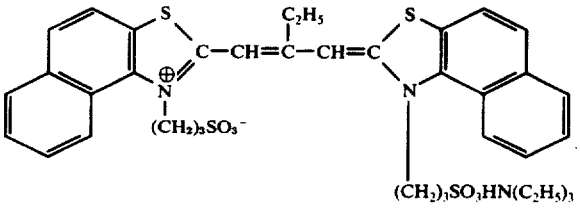

-continued

Dye (IV-D)

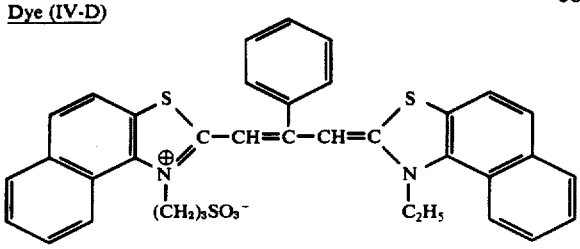

Dye (IV-E)

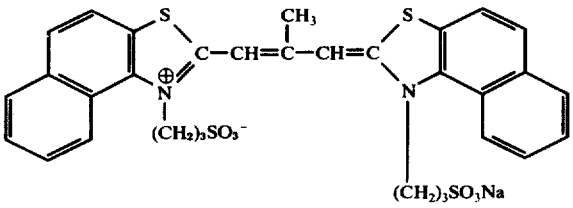

The silver halide photographic emulsions which can be used in the present invention can be produced in a conventional manner. Suitable examples of silver halides include silver chloride, silver bromide, silver iodide or mixed silver halide grains thereof, which can be produced using a single jet method, a double jet method, or a combination of these methods, followed by ripening. A preferred silver halide is silver iodobromide, silver chloroiodobromide (preferably having an iodide content of not more than about 10 mol %) or silver chlorobromide. Both silver halide grains of a conventional grain size and finely divided silver halide grains can be employed. A preferred mean diameter of the grains (measured by, e.g., a projected area method or a number average method) is from about 0.04 $\mu$ to 1.5 $\mu$. The distribution of the grain size (with the grain size having the meaning as described above) can be either narrow or wide.

The silver halide emulsions can be physically ripened or unripened. The water soluble salts are usually removed from the emulsions after the production of the grains or the physical ripening process. For this purpose, well-known washing methods and a flocculation method using inorganic salts containing a polyvalent anion (e.g., ammonium sulfate), anionic surface active agents, anionic polymers such as polystyrene sulfonic acid, or gelatin derivatives such as aliphatic or aromatic acylated gelatins can be employed.

Chemically unsensitized emulsions (the so-called unafter-ripened emulsions), and chemically sensitized emulsions can be employed as the silver halide emulsions used in the present invention. Conventionally employed chemical sensitization techniques which can be used for silver halide emulsions in the present invention include those which were described in C.E.K. Mees & T.H. James, *The Theory of the Photographic Process,* 3rd Ed., Macmillan, New York (1966), P. Grafkides, *Chimie Photographique,* Paul Montel, Paris (1957) of H. Frieser, *Die Grundlagen der photographische Prozesse mit Silberhalogeniden,* Akademische Verlagsgesellschaft (1968) and other known various chemical sensitization techniques. Namely, sulfur sensitization techniques using compounds containing sulfur reactive with silver ions such as thiosulfate; compounds as disclosed in U.S. Pat. Nos. 1,574,944, 2,278,947, 2,410,689, 3,189,458 and 3,501,313; and French Patent No. 2,059,245; and active gelatin; reduction sensitization techniques using reductive compounds such as stannous salts as disclosed in U.S. Pat. No. 2,487,850; amines as disclosed in U.S. Pat. Nos. 2,518,698, 2,521,925, 2,521,926, 2,419,973 and 2,419,975; imino-aminomethane sulfinic acid as disclosed in U.S. Pat. No. 2,983,610; and silane compounds as disclosed in U.S. Pat. No. 2,694,637; and the method as described in H.W. Wood, *Journal of Photographic Science,* Vol. 1, p. 163 (1953); gold sensitization techniques using gold complexes or gold thiosulfate complex as disclosed in U.S. Pat. No. 2,399,083; sensitization techniques using salts of noble metals such as platinum, palladium, iridium, rhodium and ruthenium, as disclosed in U.S. Pat. Nos. 2,448,060, 2,540,086, 2,566,245 and 2,566,263; and so on can be used individually or in combination thereof. In addition, selenium sensitization techniques can be used instead of or together with sulfur sensitization techniques.

The photosensitive materials can contain a wide variety of compounds for purposes of preventing fogging or stabilizing photographic functions during production, storage or processing. Namely, azoles such as benzotriazoles, benzothiazolium salts as disclosed in U.S. Pat. No. 2,131,038; aminobenzimidazoles as disclosed in U.S. Pat. No. 2,324,123; nitroazoles such as nitroindazole, nitrobenzotriazole, nitrobenzimidazole as disclosed in British Patent No. 403,789; and nitroaminobenzimidazoles as disclosed in U.S. Pat. No. 2,324,123; halogen-substituted azoles such as 5-chlorobenzimidazole, 5-bromoimidazole, 6-chlorobenzimidazole, etc.; mercaptoazoles such as mercaptothiazole derivatives as disclosed in U.S. Pat. No. 2,824,001; mercaptobenzothiazoles, mercaptobenzothiazole derivatives as disclosed in U.S. Pat. No. 2,697,099; mercaptoimidazole derivatives as disclosed in U.S. Pat. No. 3,252,799; mercaptobenzimidazoles, mercaptoxazoles, mercaptothiadiazoles as disclosed in U.S. Pat. No. 1,758,576; phenylmercaptotetrazoles as disclosed in U.S. Pat. No. 2,403,927; mercaptopyrimidines as disclosed in U.S. Pat. No. 2,304,962; mercaptotriazines as disclosed in U.S. Pat. No. 2,476,536; mercaptotetrazaindenes as disclosed in British Patent No. 3,226,231; thiosalicylic acids as disclosed in U.S. Pat. No. 2,377,375; thiobenzoic acids as disclosed in British Patent No. 3,226,231; sugar mercaptals as disclosed in Japanese Patent Publication No.

8743/72; other various kinds of mercapto compounds; oxazolinethiones as disclosed in U.S. Pat. No. 3,251,691; triazolothiadiazoles as disclosed in Japanese Patent Publication No. 17932/68; and so on can be added to the photosensitive materials employed in the present invention. Moreover, nitrogen-containing compounds which have antifogging function, for example, azaindene compounds such as tetrazaindene; compounds as disclosed in U.S. Pat. Nos. 2,444,605, 2,444,606 and 2,450,397; and Japanese Patent Publication Nos. 0166/64 and 10516/67; pentazaindenes such as those disclosed in U.S. Pat. No. 2,713,541 and Japanese Patent Publication No. 13495/68; or urazoles as disclosed in U.S. Pat. No. 2,708,161; and so on can be added. In addition, benzene sulfinic acids as disclosed in U.S. Pat. No. 2,394,198; benzene thiosulfonic acids; benzene sulfinic acid amides as disclosed in Japanese Patent Publication No. 4136/68; and so on can also be added. Moreover, a wide variety of chelating agents as disclosed in U.S. Pat. No. 2,691,588; British Patent No. 623,488; and Japanese Patent Publication Nos. 4941/68 and 13496/68 can be added to prevent fogging caused by metal ions.

To the photographic emulsion layers or other hydrophilic colloidal layers of the photosensitive material of the present invention to increase the sensitivity and contrast, or accelerate the developing speed, for example, polyalkyleneoxides as disclosed in U.S. Pat. No. 2,441,389; ethers, esters and amides of polyalkyleneoxides as disclosed in U.S. Pat. No. 2,708,161; other polyalkyleneoxides derivatives as disclosed in British Patent No. 1,145,186 and Japanese Patent Publication Nos. 10989/70, 15188/70, 43435/71, 8106/72 and 8742/72; thioether compounds as disclosed in U.S. Pat. Nos. 3,046,132 to 3,046,135 and Japanese Patent Publication Nos. 9019/70 and 1119/72; thiomorpholines as disclosed in Japanese Patent Publication No. 28325/72; quaternary ammonium compounds as disclosed in U.S. Pat. No. 3,772,021; pyrrolidines and the like as disclosed in Japanese Patent Publication No. 27037/70; urethane or urea derivatives as disclosed in Japanese Patent Publication No. 23465/65; imidazole derivatives as disclosed in Japanese Patent Publication No. 45541/72; polymers as disclosed in Japanese Patent Publication No. 26471/70; and 3-pyrazolidones as disclosed in Japanese Patent Publication No. 27670/70 can be added.

Inorganic or organic mercury compounds can be added to the photographic emulsions employed for the photosensitive materials of the present invention for sensitization or prevention of fog. For example, mercury complexes as disclosed in U.S. Pat. No. 2,728,664; benzothiazole mercury salts; mercury salt adducts as disclosed, for example, in U.S. Pat. Nos. 2,728,663 and 2,732,302; organic mercury compounds as disclosed, for example, in U.S. Pat. Nos. 2,728,665 and 3,420,668 can be employed herein.

With silver halide grains having a particularly small mean diameter (or a value corresponding thereto) (e.g., less than about 0.4 μm, or less than 0.2 μm), for example, the compounds as disclosed in British Patent Nos. 1,316,493, 1,317,138, 1,317,139, 1,317,709 and 1,297,901 and German Patent Application (OLS) No. 2,235,031 can be incorporated as a sensitizer into the photographic emulsions of the present invention.

The hardening of the emulsions and other hydrophilic colloid layers can be carried out in a conventional manner. Preferred hardeners include, for example, aldehyde compounds such as formaldehyde and glutaraldehyde; ketone compounds such as diacetyl and cyclopentanedione; active halogen-containing compounds such as bis(2-chloroethylurea), 2-hydroxy-4,6-dichloro-1,3,5-triazine and those disclosed in, for example, U.S. Pat. No. 3,288,775 and 2,732,303; and British Patent Nos. 974,723 and 1,167,207; active olefin-containing compounds such as divinylsulfone, 5-acetyl-1,3-diacryloylhexahydro-1,3,5-triazine and those compounds as disclosed in U.S. Pat. Nos. 3,635,718 and 3,232,763; and British Patent No. 994,869; N-methylol compounds such as N-hydroxymethylphthalimide and those compounds as disclosed in U.S. Pat. Nos. 2,732,316 and 2,586,168; isocyanates as disclosed in U.S. Pat. No. 3,103,437 and so on; aziridines as disclosed in U.S. Pat. Nos. 3,017,280 and 2,983,611; acid derivatives as disclosed in U.S. Pat. Nos. 2,725,294 and 2,725,295; carbodimide compounds as disclosed in U.S. Pat. No. 3,100,704; epoxy compounds as disclosed in U.S. Pat. No. 3,091,537; isooxazole compounds as disclosed in U.S. Pat. Nos. 3,321,313 and 3,543,292; halocarboxyaldehydes such as mucochloric acid; dioxane derivatives such as dihydroxydioxane, dichlorodioxane, etc.; and inorganic hardeners such as chrom alum and ziroconium sulfate, etc. In addition, instead of the above-described compounds the precursors thereof, for example, addition compounds of an alkali metal bisulfite and an aldehyde, methoylol derivatives of hydantoin, primary aliphatic nitro alcohols and so on may also be employed.

Surface active agents can be added to the photographic emulsions of the present invention, either individually or as a mixture thereof. The surface active agents are generally employed as a coating aid, but sometimes they are used for other purposes, for example, emulsifying dispersion, sensitization, improvement in the photographic characteristics, prevention from the generation of static charges and adhesion, and so on.

Examples of suitable surface active agents include natural surface active agents such as saponin; nonionic surface active agents of the alkyleneoxide type, glycerin type, glycidol type and so on; cationic surface active agents such as higher alkylamines, quaternary ammonium salts, heterocyclic compounds such as pyridine and other heterocyclics, phosphoniums, sulfoniums and so on; anionic surface active agents containing acid groups such as a carboxylic acid group, a sulfonic acid group, a phosphoric acid group, a sulfate group, a phosphate group, etc.; and ampholytic surface active agents of the amino acid type, the aminosulfonic acid type, the sulfates or phosphates of aminoalcohols and so on.

Suitable examples of such materials are disclosed in for example, U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174 and German Patent Application (OLS) No. 1,942,665; British Patent Nos. 1,077,317 and 1,198,450; Ryohei Oda et al., *Synthesis and Applications of Surface Active Agents*, Maki Shoten, (1964); A.M. Schwartz et al., *Surface Active Agents*, Interscience Publications Incorporated, (1958); J.P. Sisley et al., *Encyclopedia of Surface Active Agents*, Vol. 2, Chemical Publishing Company (1964); and so on.

The silver halide emulsions which can be employed in the present invention can contain color image forming couplers and the dispersing agents therefor when used for color photosensitive materials. These couplers usually have a structure to prevent diffusion of the couplers into other layers during production or processing.

Conventionally used open-chain diketomethylene compounds, for example, those compounds as disclosed in U.S. Pat. Nos. 3,341,331, 2,875,057 and 3,551,155; German Patent Application (OLS) No. 1,547,868; and U.S. Pat. Nos. 3,265,506, 3,582,322 and 3,725,072; German Patent Application (OLS) No. 2,162,899; U.S. Pat. Nos. 3,369,895 and 3,408,194; and German Patent Application (OLS) Nos. 2,057,941, 2,213,461 2,219,917, 2,261,361 and 2,263,875; can be employed as yellow couplers.

5-Pyrazolone compounds are mainly employed as magenta couplers and indazolone series compounds and cyanoacetyl compounds can be also used. For example, those compounds as disclosed in U.S. Pat. Nos. 2,439,098, 2,600,788, 3,062,653 and 3,558,319; British Patent No. 956,261; U.S. Pat. Nos. 3,582,322, 3,615,506, 3,519,429, 3,311,476 and 3,419,391; Japanese Patent Application Nos. 21454/73 and 56050/73; German Patent No. 1,810,464; Japanese Patent Publication No. 2016/69; Japanese Patent Application No. 45971/73; U.S. Pat. No. 2,983,608; and so on can be employed.

Phenol and naphthol derivatives are mainly employed as cyan couplers which can be incorporated in the silver halide photographic emulsion used in the present invention. For example, those compounds as disclosed in U.S. Pat. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034,892 and 3,583,971; German Patent Application (OLS) No. 2,163,811; Japanese Patent Publication No. 28836/70; Japanese Patent Application No. 33283/73; and so on can be employed.

Development inhibiting compound-releasing type couplers (the so-called DIR couplers), and compounds which can release compounds having a development inhibiting action can be also incorporated into the photographic emulsions of the present invention. Specific examples of the above-described materials are described in U.S. Pat. Nos. 3,148,062, 3,227,554, 3,253,924, 3,617,291, 3,622,328 and 3,705,201; British Patent No. 1,201,110; U.S. Pat. Nos. 3,297,445, 3,379,529 and 3,639,417 and so on.

Two or more of the above-described couplers and the like can be incorporated into the same layer, or the same compound can also be incorporated into two or more different layers to achieve the characteristics required for the photosensitive materials.

Acylated gelatins such as phthaloylated gelatin and malonoylated gelatin; cellulose compounds such as hydroxyethylcellulose and carboxymethylcellulose; soluble starchs such as dextrin; and hydrophilic polymers such as polyvinyl alcohol, polyvinyl pyrrolidone, polyacrylamide and polystyrene sulfonic acid can be added to the silver halide photographic emulsions employed in the present invention, in addition to gelatin as a protective colloid, and plasticizers for dimensional stabilization, latex polymers and matting agents can also be added.

The finished emulsion is coated on a suitable support. Examples of supports include glass plates of glasses such as soda glass, quartz glass, etc.; synthetic polymer films of polyalkyl (meth)acrylates, polystyrene, polyvinyl chloride, partially formalated polyvinyl alcohol, polyesters such as polycarbonate and polyethylene terephthalate or polyamides; films of cellulose derivatives such as cellulose nitrate, cellulose acetate, cellulose acetate butyrate, etc.; paper, baryta-coated paper, α-olefin resin-coated paper, synthetic paper of polystyrene, etc.; and other supports such as ceramics, metal, etc.; can be used. The supports can be either transparent or translucent supports conventionally used for a photographic elements.

The present invention can be used in producing silver halide photographic emulsions employed for a wide variety of both color and monochromatic photosensitive materials. Specific examples of such emulsions are, for example, color positive emulsions, emulsions for color paper, color negative emulsions, reversal color emulsions, (with or without couplers), emulsions for photographic light-sensitive materials for the graphic arts (e.g., the so-called lithographic type light-sensitive materials and so on), emulsions employed for photosensitive materials for recording cathode ray tube displays, emulsions for light-sensitive materials for recording X-rays (particularly direct and indirect materials using a fluorescent screen), emulsions for the colloid transfer process as disclosed in U.S. Pat. No. 2,716,095; emulsions employed for the silver salt diffusion transfer process as disclosed in e.g., U.S. Pat. Nos. 2,352,014, 2,543,181, 3,020,155 and 2,861,885; emulsions for the color diffusion transfer process (e.g., as disclosed in U.S. Pat. Nos. 3,087,817, 3,185,567, 2,983,606, 3,253,915, 3,227,550, 3,227,551, 3,227,552, 3,415,644, 3,516,645 and 3,415,646), emulsions for the dye transfer process (imbibition transfer process) (e.g., as disclosed in U.S. Pat. No. 2,882,136), emulsions for the silver dye bleaching method as described in Friedman, *History of Color Photography,* American Photographic Publishers Co., (1944), particularly Chapter 24, and *British Journal of Photography,* Vol. 111, pp. 308 - 309 (Apr. 7, 1964) and so on, emulsions employed for recording printout images (as disclosed, e.g., in U.S. Pat. No. 2,369,449; Belgian Patent No. 704,255 and so on), emulsions for light-developing type printing-out light-sensitive materials (e.g., those emulsions as disclosed in U.S. Pat. Nos. 3,033,682, 3,287,137 and so on), emulsions employed for heat developable light-sensitive materials (e.g., those emulsions as disclosed in U.S. Pat. Nos. 3,152,904, 3,312,550 and 3,148,122; British Patent No. 1,110,046 and so on), emulsions employed for physical developing light-sensitive materials (e.g., those emulsions as disclosed in British Patent Nos. 920,277 and 1,131,138 and so on).

The supersensitizing technique in accordance with the present invention is very useful for the production of light-sensitive emulsions for multi-layer coupler-in-the-emulsion type color photosensitive materials which are preferably used for lithographic type photosensitive materials for the graphic arts, particularly reversal photosensitive materials and negative color photosensitive materials; high sensitive monochromatic negative photosensitive materials; and micronegative photosensitive materials for exposure using X-rays.

The light-sensitive materials which can be used to reproduce very high contrast images by a processing wherein dihydroxybenzenes are usually employed as a developing agent and the developing is allowed to proceed infectiously under the condition of a low sulfite ion concentration with the intention of reproducing photographically line images or half-tone images composed of dots, are called "lithographic type" light-sensitive materials (which are described in detail in L.F.A. Mason, *Photographic Processing Chemistry,* pp. 163 - 165, Focal Press, London (1966), and such can be used in this invention.

Moreover, the dyes employed in the present invention can be used for spectral sensitization according to the methods as disclosed in German Patent Application (OLS) No. 2,104,283 and U.S. Pat. No. 3,649,286.

The present invention will now be illustrated in greater detail by reference to the following examples. However, the invention is not intended to be construed as being limited to these examples. Unless otherwise indicated, all parts, percents, ratios and the like are by weight.

EXAMPLE 1

Silver halide grains were precipitated using a double jet method, subjected to physical ripening in a conventional manner (P. Grafkides, *Chimie et Physique Photographiques,* pages 367, 443, (1957)), desalted and followed by chemical ripening. Thus, a silver chloroiodobromide emulsion (iodide content: 0.25 mol % and bromide content: 16.5 mol %) was obtained. The silver halide grains contained in this emulsion had a mean diameter of 0.4 $\mu$. This emulsion contained 1.18 mol of silver halide per 1 kg thereof. 1 kg portions of this emulsion were weighed out, which were then placed in a 50° C thermostatic bath to melt the emulsion. Methanol solutions of the sensitizing dyes of the present invention and sensitizing dyes for comparison were added to the emulsion portions in predetermined amounts, and mixed and stirred at 40° C. To each emulsion portion were added 20 cc of a 1% by weight aqueous solution of 4-hydroxy-6-methyl-1,3,3*a*, 7-tetrazaindene, 10 cc of a 1 wt % aqueous solution of 1-hydroxy-3,5-dichlorotriazine sodium salt and 10 cc of a 1 wt % aqueous solution of sodium dodecylbenzene sulfonate, and stirred. Each of the thus-finished emulsion portions was applied to a cellulose triacetate film support in a dry thickness of 5 $\mu$ and then dried. Thus, samples of light-sensitive materials were obtained. Each of these film samples was cut into strips.

Two of the strips were wedgewise exposed using a sensitometer containing a light source of a color temperature of 5400° K, covered, respectively, by a blue filter (Wratten-47B) and a green filter (Wratten-58). The exposure time was 1/20 second. On the other hand, one remaining strip was exposed using a grating spectrophotograph having a tungsten light source of a color temperature of 2666° K to obtain a spectrogram.

The thus-exposed strips were development-processed at 20° C for 2 minutes using a developer having the following composition following by stopping, fixing and washing.

Composition of the Developer

Water: 500 ml
Metol: 2 g
Sodium Sulfite (anhydrous): 40 g
Hydroquinone 4 g
Sodium Carbonate (monohydrate): 28 g
Potassium Bromide: 1 g
Water to make: 1 l On use, an equal volume of water was added to the developer. Thus, strips having black-and-white images were obtained. The density of these images was measured using an S-type densitometer (made by Fuji Photo Film Co., Ltd.). Thus, the blue filter sensitivity ($S_B$) and the green filter sensitivity ($S_G$) and fog were obtained. The standard point of the optical density to determine the sensitivity was fog + 0.20.

The results obtained are shown in Table 1. The sensitivity is shown as a relative value.

TABLE 1

Figure 2:
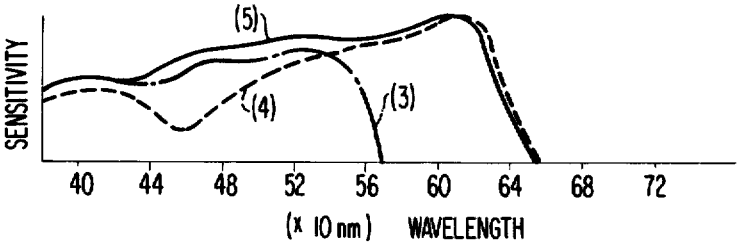
Figure 3:
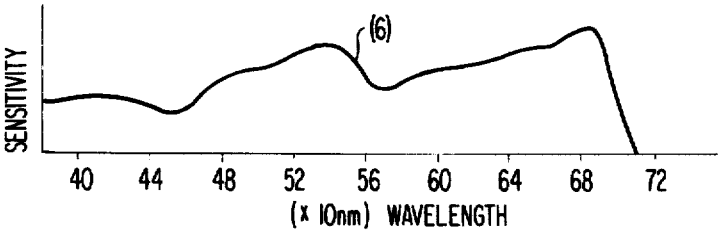
Figure 4:
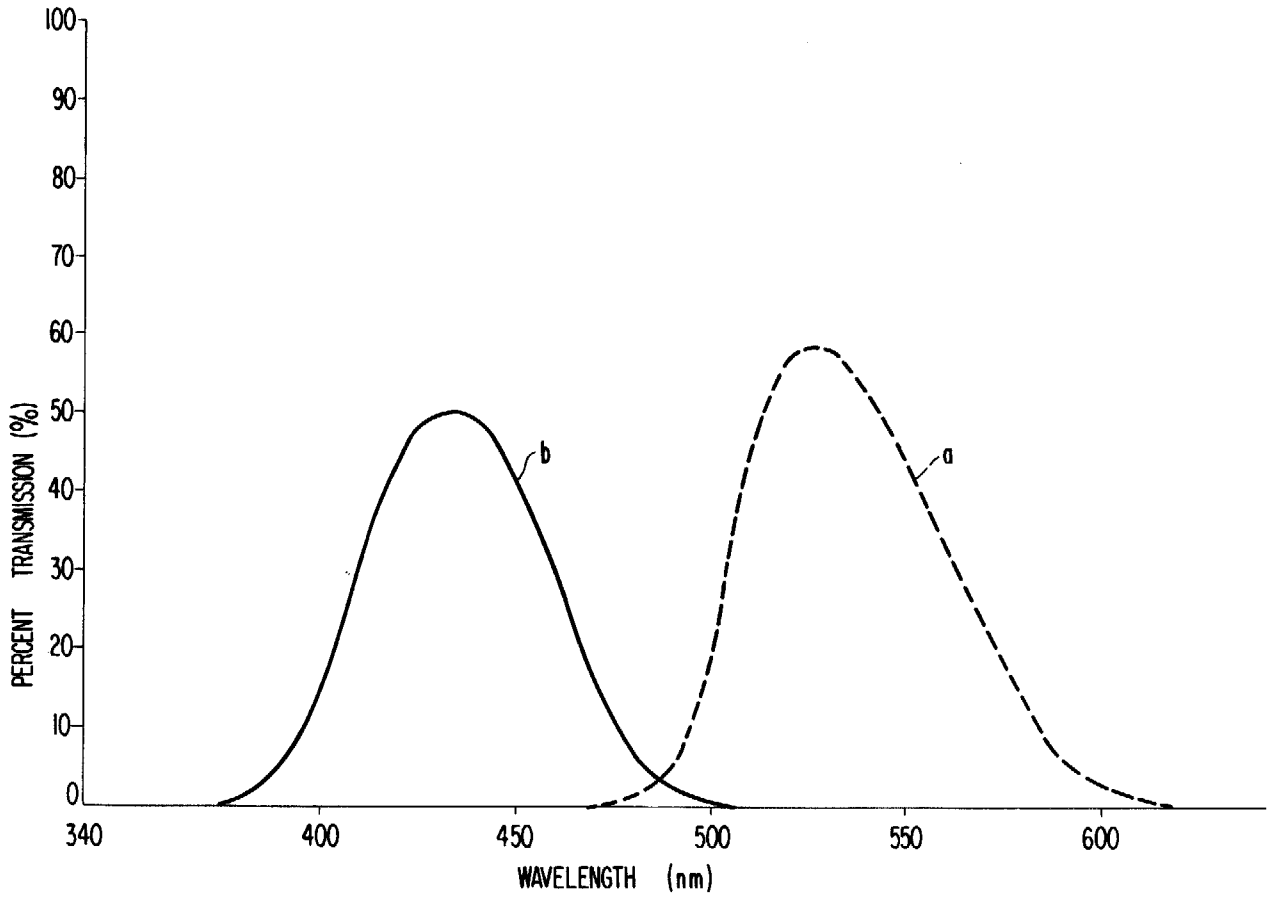
FIG. 4 shows the percent transmission curves (a) and (b) of filters Wratten Nos. 58 and 47B, respectively.

| Run No. | Dye and Amount Used × $10^{-5}$ mol | | Dye and Amount Used × $10^{-5}$ mol | | Dye and Amount Used × $-^{5}$ mol | | $S_G$* | $S_B$* | Fog | Spectrogram |
|---|---|---|---|---|---|---|---|---|---|---|
| 1 | | — | | — | | — | — | 100 | 0.05 | |
| | (I-F) | 8 | | — | | — | 81 | 107 | 0.05 | |
| | | 16 | | — | | — | 119 | 111 | 0.05 | FIG. 1-1 |
| | | 32 | | — | | — | 115 | 106 | 0.06 | |
| | | — | (II-A) | 16 | | — | 100 | 148 | 0.05 | |
| | | — | | 32 | | — | 119 | 182 | 0.05 | FIG. 2-3 |
| | | — | | 48 | | — | 119 | 160 | 0.06 | |
| | (I-F) | 16 | (II-A) | 16 | | — | 143 | 148 | 0.05 | |
| | | 16 | | 32 | | — | 143 | 182 | 0.05 | FIG. 1-2 |
| 2 | (I-F) | 16 | (II-A) | 16 | (IV-C) | 6 | 148 | 148 | 0.06 | |
| | | 16 | | 32 | | 6 | 148 | 182 | 0.06 | |
| 3 | (I-F) | 16 | (II-A) | 32 | (III-B) | 4 | 153 | 182 | 0.05 | |
| | | 16 | | 32 | | 8 | 160 | 182 | 0.05 | |
| 4 | (I-K) | 8 | | — | | — | 67 | 107 | 0.05 | |
| | | 16 | | — | | — | 90 | 107 | 0.05 | |
| | | 32 | | — | | — | 86 | 98 | 0.07 | |
| | | — | (II-B) | 16 | | — | 96 | 142 | 0.05 | |
| | | — | | 32 | | — | 114 | 175 | 0.05 | |
| | | — | | 48 | | — | 100 | 148 | 0.07 | |
| | (I-K) | 8 | (II-B) | 32 | | — | 139 | 186 | 0.05 | |
| | | 16 | | 32 | | — | 145 | 174 | 0.05 | |
| 5 | (I-L) | 8 | | — | | — | 100 | 123 | 0.05 | |
| | | 16 | | — | | — | 158 | 123 | 0.05 | |
| | | 32 | | — | | — | 137 | 100 | 0.07 | |
| | (I-L) | 8 | (II-A) | 32 | | — | 166 | 192 | 0.05 | |
| | | 16 | | 32 | | — | 190 | 182 | 0.05 | |
| 6 | (I-L) | 16 | (II-A) | 32 | (IV-A) | 6 | 190 | 182 | 0.05 | |
| | | 16 | | 32 | | 12 | 190 | 182 | 0.06 | |
| 7 | (I-A) | 8 | | — | | — | 75 | 123 | 0.05 | |
| | | 16 | | — | | — | 112 | 127 | 0.05 | FIG. 2-4 |
| | (I-A) | 32 | | — | | — | 106 | 123 | 0.07 | |
| | (I-A) | 8 | (II-A) | 32 | | — | 152 | 200 | 0.05 | |
| | | 16 | | 32 | | — | 158 | 192 | 0.05 | FIG. 2-5 |
| 8 | (I-A) | 8 | (II-B) | 32 | | — | 148 | 192 | 0.05 | |
| | | 16 | | 32 | | — | 158 | 192 | 0.05 | |
| 9 | (I-H) | 8 | | — | | — | 80 | 100 | 0.05 | |
| | | 16 | | — | | — | 116 | 103 | 0.05 | |
| | | 32 | | — | | — | 110 | 88 | 0.07 | |
| | | — | (II-F) | 16 | | — | 148 | 148 | 0.05 | |
| | | — | | 32 | | — | 142 | 167 | 0.05 | |
| | | — | | 48 | | — | 127 | 153 | 0.06 | |
| | (I-H) | 8 | (II-F) | 16 | | — | 164 | 167 | 0.05 | |
| | | 16 | | 16 | | — | 170 | 175 | 0.05 | |
| 10 | (I-E) | 8 | | — | | — | 53 | 107 | 0.05 | |

TABLE 1-continued

| Run No. | Dye and Amount Used × 10−5 mol | | Dye and Amount Used × 10−5 mol | | Dye and Amount Used × −5 mol | | $S_G$* | $S_B$* | Fog | Spectrogram |
|---|---|---|---|---|---|---|---|---|---|---|
| | | 16 | | — | | — | 75 | 107 | 0.05 | |
| | | 32 | | — | | — | 65 | 98 | 0.06 | |
| | | — | (II-D) | 16 | | — | 83 | 117 | 0.05 | |
| | | — | | 32 | | — | 100 | 140 | 0.05 | |
| | | — | | 48 | | — | 92 | 132 | 0.06 | |
| | (I-E) | 8 | (II-K) | 32 | | — | 115 | 140 | 0.05 | |
| | | 16 | | 32 | | — | 120 | 140 | 0.05 | |
| 11 | (I-I) | 8 | | — | | — | 83 | 107 | 0.05 | |
| | | 16 | | — | | — | 115 | 107 | 0.05 | |
| | | 32 | | — | | — | 102 | 100 | 0.07 | |
| | (I-I) | 8 | (II-K) | 16 | | — | 115 | 117 | 0.05 | |
| | | 16 | | 16 | | — | 130 | 117 | 0.05 | |
| 12 | | — | (II-J) | 16 | | — | 4 | 160 | 0.05 | |
| | | — | | 32 | | — | 5 | 197 | 0.05 | |
| | | — | | 48 | | — | 5 | 167 | 0.06 | |
| | (I-K) | 16 | (II-J) | 16 | | — | 105 | 160 | 0.05 | |
| | | 16 | | 32 | | — | 105 | 197 | 0.05 | |
| 13 | | — | (II-L) | 16 | (IV-C) | 12 | 72 | 114 | 0.05 | |
| | | — | | 32 | | 12 | 75 | 114 | 0.05 | FIG. 3-6 |
| | | — | | 32 | | 18 | 72 | 110 | 0.06 | |
| 14 | | — | (II-L) | 16 | (IV-A) | 16 | 63 | 114 | 0.05 | |
| | | — | | 32 | | 16 | 63 | 114 | 0.06 | |

*Relative value

Run Nos. 13 and 14 in Table 1 wherein the combinations of Dye (IV-C) with Dye (II-L), and Dye (IV-A) with Dye (II-L), employed as examples of a conventional techniques as disclosed in German Patent Application (OLS) No. 2,239,711, were conducted for comparison. It will be clearly understood from a comparison of the examples of the combination of dyes of the present invention showing a supersensitizing action with these comparative examples that the sensitizing dyes of the present invention have higher green-sensitivity.

Similar results to the above-described results were obtained when a light source having an illumination intensity 40 times stronger was used as a light source in Example 1, and 1/1000 sec of exposure was adopted.

This fact is particularly advantageous for panchromatically spectral sensitized light-sensitive materials for the graphic arts.

Moreover, the above-described characteristics, namely, very high green- and blue-sensitivity, are most suitable for X-ray photography through a fluorescent screen. Further, the above-described characteristics of the present invention are useful for sensitive materials satisfying high intensity of illumination and short time exposure requirements, for example, current information transmitting systems such as press facsimile systems, high speed phototypesetting systems, cathode ray tube diaplay systems, high speed photographic recording systems using lasers and so on.

The effects of the combination of dyes of the present invention were not adversely affected in any way by the addition of, for example, green-sensitive cyanine dyes (e.g., oxacarbocyanine, imidacarbocyanine, or 2,2'-cyanine dyes as shown in Run No. 3) or red-sensitive cyanine dyes as shown in Run Nos. 2 and 6. In addition, cyanine Dyes (IV-C), (III-B) and (IV-A) which were employed in Run Nos. 2, 3 and 6 of Table 1, (III-A), (III-C), (III-D), (IV-B), (IV-D) and (IV-E) can also be present with the combination of dyes of the present invention without impairing the effects of supersensitization obtained in the present invention. In addition, the supersensitization effect resulting in the combination of dyes of the present invention can be obtained similarly to the above-described example even if emulsions containing couplers therein receive color-processing after exposure.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing, in supersensitizing amounts, the combination of at least one sensitizing dye represented by the following general formula (I)

(I)

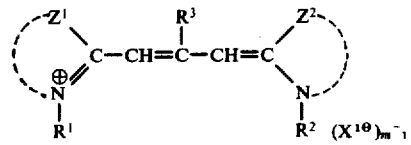

wherein $Z^1$ represents the atoms necessary to form a benzimidazole ring, an oxazole ring, a benzoxazole ring or a naphthoxazole ring; $Z^2$ represents the atoms necessary to form a thiazole ring, a benzothiazole ring, a naphthothiazole ring, a selenazole ring, a benzoselenazole ring or a naphthoselenazole ring; $R^1$ and $R^2$ each represents an aliphatic group; $R^3$ represents a hydrogen atom, an alkyl group, an aryl group or an aralkyl group; $X^1$ represents an acid anion; *m* represents 1 or 2, and *m* represents 1 when the dye forms an intramolecular salt; and at least one second sensitizing dye represented by the following general formula (II)

(II)

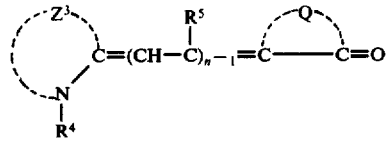

wherein $Z^3$ represents the atoms necessary to complete a benzoxazole, ring; Q represents the atoms necessary to form a thiohydantoin ring; $R^4$ represents an aliphatic group; $R^5$ represents a hydrogen atom, an alkyl group, an aryl group or an aralkyl group; and *n* is 2.

2. The silver halide photographic emulsion as describd in claim 1, wherein $Z^1$ forms a benzoxazole ring or a naphtho[1,2-d]oxazole ring and $Z^2$ forms a benzothiazole ring, a benzoselenazole ring or a naphtho[1,2-d]thiazole ring.

3. The silver halide photographic emulsion as described in claim 1, wherein $Z^1$ forms a benzimidazole ring and $Z^2$ forms a benzothiazole ring, a benzoselenazole ring, a naphtho[1,2-d]thiazole ring or a naphtho[1,2-d]selenazole ring.

4. The silver halide photographic emulsion as described in claim 1, wherein $Z^1$ forms a naphtho[1,2-d]oxazole ring or a benzoxazole ring which may be substituted with a chlorine atom, a methyl group or a methoxy group at the 5-position; $Z^2$ forms a benzothiazole ring which may be substituted with a chlorine atom, a methyl group, a methoxy group or a phenyl group at the 5-position or a benzoselenazole ring; and $R^3$ is a methyl group or an ethyl group.

5. The silver halide photographic emulsion as described in claim 1, wherein at least one of $R^1$ or $R^2$ is a sulfoalkyl group, a carboxyalkyl group or a hydroxyalkyl group.

6. The silver halide photographic emulsion as described in claim 1, wherein at least one sensitizing dye represented by the general formula (I) and at least one sensitizing dye represented by the general formula (II) each is incorporated in a supersensitizing amount ranging from about $1 \times 10^{-6}$ mol to $5 \times 10^{-3}$ mol per mol of silver halide.

7. The silver halide photographic emulsion as described in claim 6, wherein the molar ratio of the dye represented by the general formula (I) to the dye represented by the general formula (II) ranges from about 1:10 to 10:1.

8. The silver halide photographic emulsion as described in claim 1, wherein at least one sensitizing dye represented by the general formula (I) and at least one sensitizing dye represented by the general formula (II) each is incorporated in a supersensitizing amount ranging from $1 \times 10^{-5}$ mol to $2.5 \times 10^{-3}$ mol per mol of silver halide.

9. The silver halide photographic emulsion as described in claim 1, wherein the emulsion additionally contains at least one sensitizing dye represented by the general formula (III) or (IV)

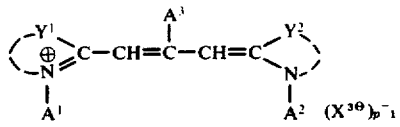

III wherein $Y^1$ and $Y^2$ each represents the atoms necessary to form a benzoxazole ring, a naphtho[1,2-d]oxazole ring, or a benzoimidazole ring which may be substituted with groups which do not adversely affect the sensitivity; $A^1$ and $A^2$ each represents an aliphatic group; $A^3$ represents a hydrogen atom or an alkyl group having 1 to 3 carbon atoms; and $X^2$ and $n$ each has the same meaning as $X^1$ and $m$, respectively, of the general formula (I);

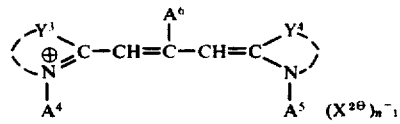

(IV)

wherein $Y^3$ and $Y^4$ each represents the atoms necessary to form a benzothiazole ring, a benzoselenazole ring, a naphtho[1,2-d]thiazole ring or a naphtho[1,2-d]selenazole ring which may be substituted with substituents which do not adversely affect the sensitivity; $A^4$ and $A^5$ each represents an aliphatic group; $A^6$ represents an alkyl group having 1 to 3 carbon atoms or an aryl groups; and $X^3$ and $p$ each has the same meaning as $X^1$ and $m$, respectively, of the general formula (I).

10. A silver halide light-sensitive material comprising a support having thereon the silver halide photographic emulsion as described in claim 1.

11. A silver halide light-sensitive material comprising at least one layer containing the silver halide photographic emulsion as described in claim 1, and wherein the emulsionadditionally contains at least one coupler.

* * * * *